US008347799B2

(12) United States Patent
Maki et al.

(10) Patent No.: US 8,347,799 B2
(45) Date of Patent: Jan. 8, 2013

(54) SEWING MACHINE OPERATING DEVICE AND SEWING MACHINE PROVIDED THEREWITH

(75) Inventors: Ryutaro Maki, Gifu (JP); Takafumi Naka, Ama (JP); Shoichi Taguchi, Toyohashi (JP); Masayuki Iwata, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/216,864

(22) Filed: Aug. 24, 2011

(65) Prior Publication Data

US 2012/0060733 A1 Mar. 15, 2012

(30) Foreign Application Priority Data

Sep. 14, 2010 (JP) ..... 2010-205552

(51) Int. Cl.
*D05B 69/18* (2006.01)

(52) U.S. Cl. ..... 112/277

(58) Field of Classification Search ..... 112/271, 112/277, 275, 274

See application file for complete search history.

(56) References Cited

U.S. PATENT DOCUMENTS 3,253,562 A * 5/1966 Hedegaard ..... 112/275
3,400,677 A * 9/1968 Bowers et al. ..... 112/275
4,100,868 A * 7/1978 Reinecke et al. ..... 112/277
4,299,182 A * 11/1981 Tanaka ..... 112/277
4,426,947 A * 1/1984 Marshall ..... 112/272
2010/0313805 A1 12/2010 Kishi

FOREIGN PATENT DOCUMENTS

JP U-64-011182 1/1989
JP A-10-118380 5/1998
JP A-2012-61042 3/2012

OTHER PUBLICATIONS

U.S. Appl. No. 13/217,969, filed Aug. 25, 2011 in the name of Yamanashi et al.

* cited by examiner

*Primary Examiner* — Danny Worrell
(74) *Attorney, Agent, or Firm* — Oliff & Berridge, PLC

(57) ABSTRACT

A sewing machine operating device includes a plurality of operating members configured to be operated by a user with his/her foot, the operating members having respective detectors which each detect an action of the foot in a contact or non-contact manner and include at least two detectors mounted so as to be opposed to each other while the foot placed on the base is interposed between the detectors from sides of the foot, a signal output unit configured to generate an operation signal according to operation of each operating member and deliver the operation signal via a connecting mechanism to the sewing machine body, and a position adjusting mechanism configured to change a position of at least one of the operating members mounted on the base, the position adjusting mechanism including a distance adjusting mechanism adjusting a distance between the at least two detectors in an increasing or decreasing direction.

6 Claims, 11 Drawing Sheets

SEWING MACHINE OPERATING DEVICE AND SEWING MACHINE PROVIDED THEREWITH

CROSS-REFERENCE TO RELATED APPLICATIONS

This application is based upon and claims the benefit of priority from the prior Japanese Patent Application No. 2010-205552 filed on Sep. 14, 2010, the entire contents of which are incorporated herein by reference.

BACKGROUND

1. Technical Field

The present disclosure relates to a sewing machine operating device which is connected to a sewing machine body to work the sewing machine according to an action of user's foot and a sewing machine provided with the operating device.

2. Related Art

Conventional sewing machines include a type in which a user connects a foot pedal to a sewing machine and operates the foot pedal with his/her foot, more specifically, the user presses the foot pedal to instruct start or stop of a sewing operation and adjustment of a sewing speed or a rotational speed of a sewing machine motor without use of his/her hands.

Recently, furthermore, an operating device provided with a switch has been proposed. The switch is operated by user's foot in order that an operation to move a presser foot upward may be instructed or a thread cutting operation may be instructed. In this case, the aforementioned switch is disposed lateral to the foot pedal and includes an operating member such as a push button or a lever. The user operates the operating member by one side of his/her foot.

In the foregoing construction, however, the user needs to rotatively move or swing his/her toe in the right-left direction while slightly floating the toe from the foot pedal. This is not necessarily an easy operation for the user. Furthermore, users differ in their feet sizes, particularly in feet widths. However, the sizes of feet have not been considered. Accordingly, there have been sometimes cases in which the operability has been reduced, depending upon the size of the foot.

SUMMARY

Therefore, an object of the disclosure is to provide a sewing machine operating device which operates a sewing machine according to an action of a foot and can improve the operability in spite of differences in foot sizes of the users, and a sewing machine provided with the operating device.

The present disclosure provides a sewing machine operating device comprising a base: a connecting mechanism that is configured to electrically connect the sewing machine operating device to a sewing machine body; a plurality of operating members which is mounted on the base and configured to be operated by a user with his/her foot, the operating members having respective detectors which each detect an action of the foot in a contact or non-contact manner and include at least two detectors which are mounted so as to be opposed to each other while the foot placed on the base is interposed between the detectors from sides of the foot: a signal output unit that is configured to generate an operation signal according to operation of each operating member and delivers the operation signal via the connecting mechanism to the sewing machine body; and a position adjusting mechanism that is configured to change a position of at least one of the operating members mounted on the base, the position adjusting mechanism including a distance adjusting mechanism which adjusts a distance between the at least two detectors in an increasing or decreasing direction.

The disclosure also provides a sewing machine comprising a sewing machine body; and a sewing machine operating device including a base; a connecting mechanism that is configured to electrically connect the sewing machine operating device to a sewing machine body; a plurality of operating members which is mounted on the base and configured to be operated by a user with his/her foot, the operating members having respective detectors that are configured to each detect an action of the foot in a contact or non-contact manner and including at least two detectors which are mounted so as to be opposed to each other while the foot placed on the base is interposed between the detectors from sides of the foot; a signal output unit that is configured to generate an operation signal and delivers the operation signal via the connecting mechanism to the sewing machine body; and a position adjusting mechanism that is configured to change a position of at least one of the operating members mounted on the base.

DETAILED DESCRIPTION

A first embodiment will be described with reference to FIGS. 1 to 8. The first embodiment is directed to an operating device for use with a household electronic sewing machine, for example.

Figure 1:
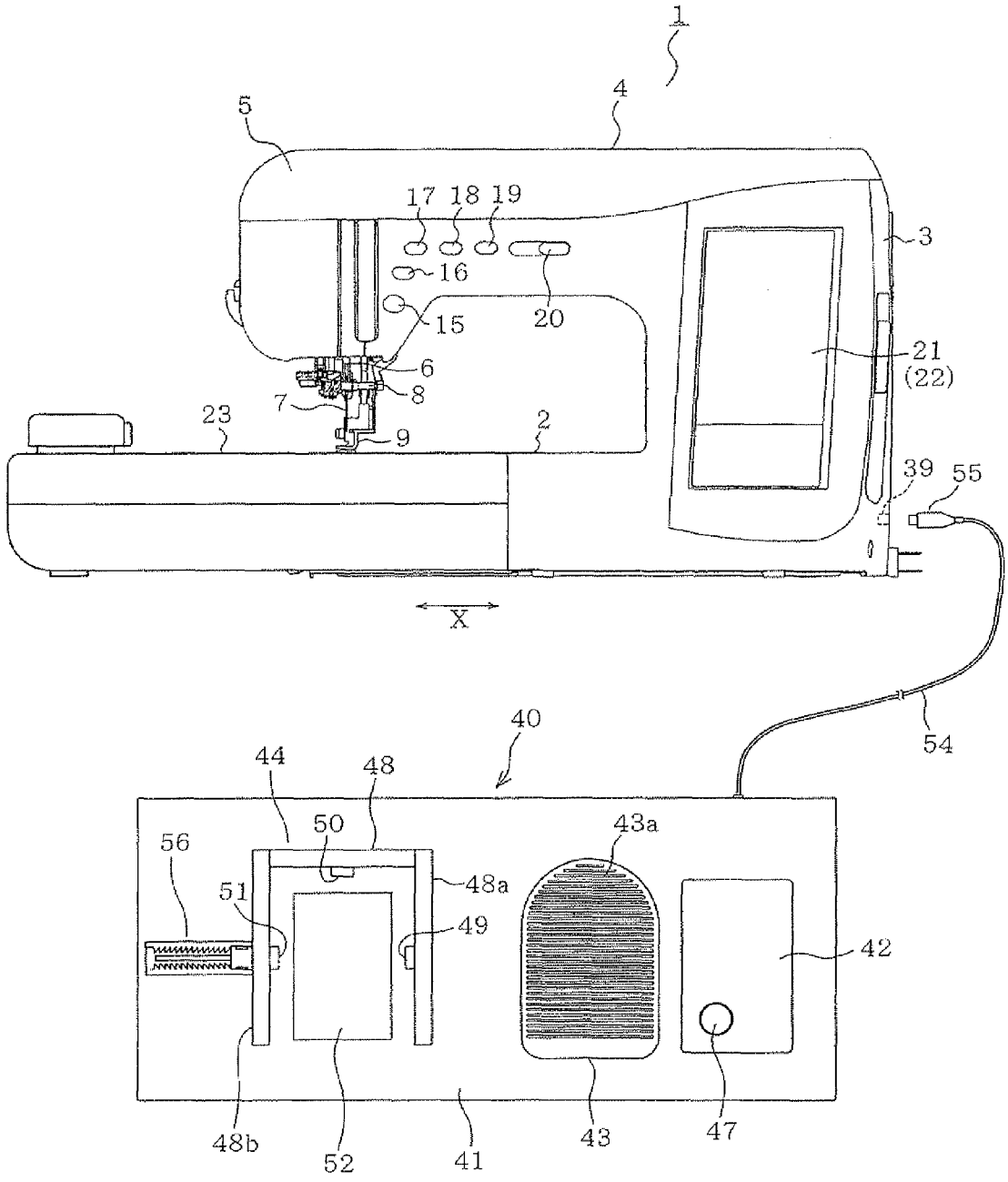
FIG. 1 shows an overall construction of a sewing machine to which a sewing machine operating device according to one embodiment is to be connected.

Referring to FIG. 1, a sewing machine body 1 of the sewing machine is shown. An overall construction of the sewing machine body 1 will now be described. The sewing machine body 1 includes a sewing machine bed 2 extending in the X direction or a right-left direction, a pillar 3 extending upward from a right end of the sewing machine bed 2 and an arm 4 extending leftward from an upper end of the pillar 3 as viewed in FIG. 1. The bed 2, the pillar 3 and the arm 4 are formed integrally with one another. The arm 4 has a distal end serving as a head 5. A needle bar 6 is mounted on the head 5 so as to be movable upward and downward and swingable in the X direction. The needle bar 6 has a lower end to which a needle 7 is attached. A presser bar 8 is also mounted on the head 5 so as to be located behind the needle bar 6. The presser bar 8 has a lower end on which a presser foot 9 is detachably or replaceably mounted. A known presser driving mechanism is provided in the head 5 to move the presser foot 9, namely, the presser bar 8 between upper and lower positions. The presser driving mechanism is driven by a presser drive motor 10 (see FIG. 2).

Figure 2:
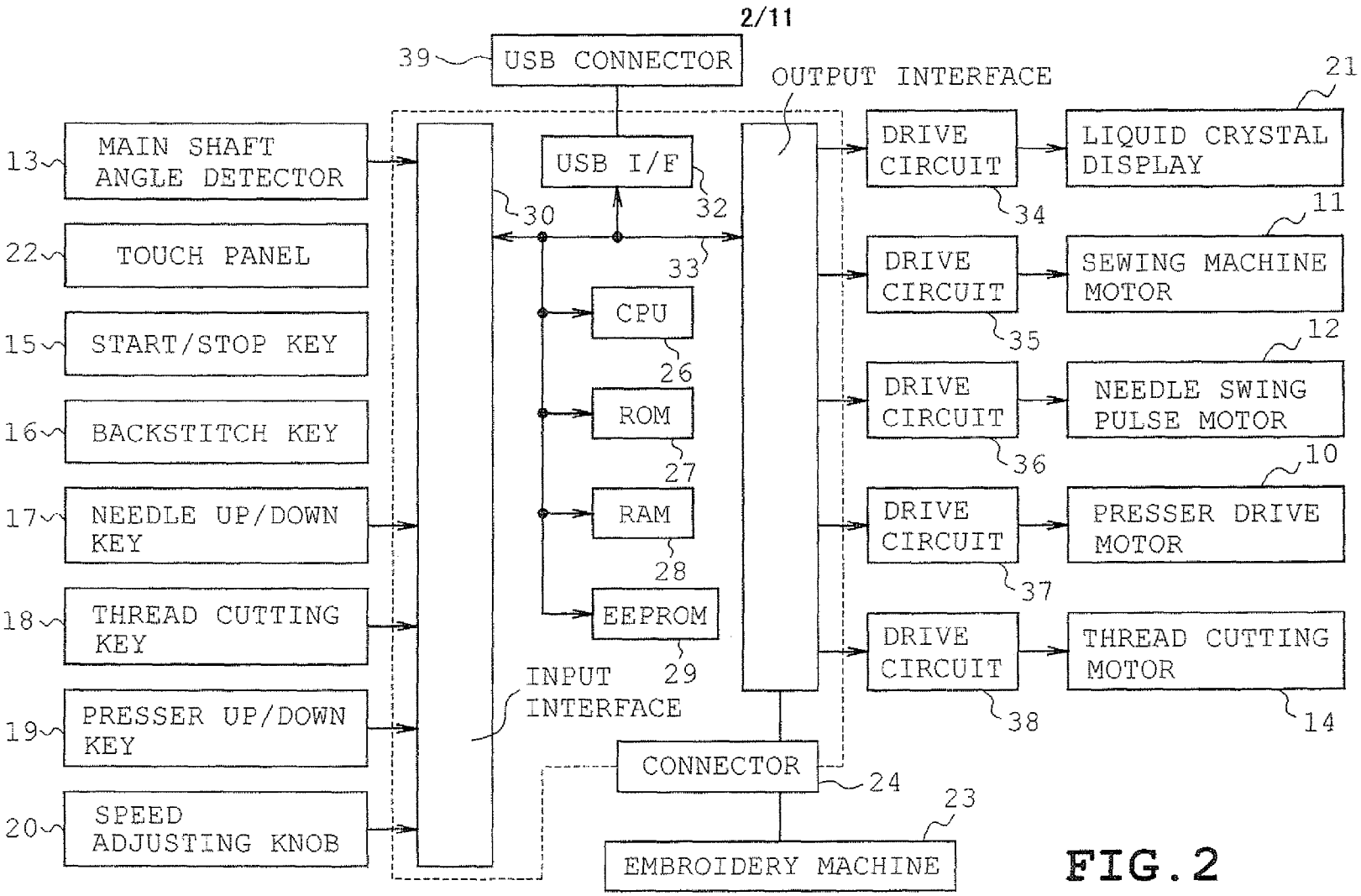
FIG. 2 is a schematic block diagram showing an electrical arrangement of the sewing machine.

In the arm 4 are provided a main shaft driven by a sewing machine motor 11 which is shown only in FIG. 2 and a main shaft angle detector 13 which detects a rotational angle of the main shaft and which is shown only in FIG. 2. In the head 5 are provided a needle bar driving mechanism which moves the needle bar 6 upward and downward and a needle thread take-up driving mechanism which moves a needle thread take-up upward and downward in synchronization with the upward and downward movement of the needle bar 6, although neither mechanism is shown. A needle bar swinging mechanism, a thread tension adjusting device and the like are further provided in the head 5. The needle bar swinging mechanism swings the needle bar 6 in the X direction perpendicular to a cloth feed direction with a needle swing pulse motor 12 (shown in FIG. 2) serving as a drive source. The thread tension adjusting device adjusts a tension of a needle thread. The needle bar driving mechanism and the needle thread take-up driving mechanism are driven by the main shaft. A rotational angle of the main shaft is detected by the main shaft angle detector 13, whereby a vertical position of the needle bar 6 is specified.

A needle plate (not shown) is mounted on an upper surface of the bed 2. In the bed 2 are provided a feed dog driving mechanism which drives a feed dog in synchronization with the upward and downward movement of the needle bar 6, a rotary hook which houses a bobbin and forms stitches in cooperation with the needle 7, an automatic thread cutting mechanism and the like. The automatic thread cutting mechanism includes a known mechanism which is driven by a thread cutting motor 14 (see FIG. 2) serving as a drive source. Both bobbin and needle threads are automatically cut by the automatic thread cutting mechanism at a lower surface side of the needle plate after completion of a sewing operation.

An embroidery machine 23 is detachably attached to a left side portion of the bed 2. An embroidery frame (not shown) holding a workpiece cloth is adapted to be attached to the embroidery machine 23. The embroidery frame attached to the embroidery machine 23 is moved on the bed 2 freely in the X direction and the Y direction or a front-back direction perpendicular to the X direction. The embroidery machine 23 attached to the bed 2 is electrically connected via a connector 24 (see FIG. 2) provided in the bed 2 to a control device 25 of the sewing machine as will be described later. In the embodiment, however, a sewing machine operating device 40 is used in a normal sewing in which the embroidery machine 23 is not used, as will be described later. The sewing machine operating device will hereinafter be referred to as "operating device."

Various operation keys are provided on the front of the arm 4 as shown in FIG. 1. More specifically, the operation keys include a start/stop key 15 instructing start or stop of the sewing machine motor 11, a backstitch key 16 instructing backstitch, a needle up/down key 17 instructing switching between needle-up and needle-down with respect to a stop position of the needle bar 6, a thread cutting key 18 instructing thread cutting, a presser up/down key 19 instructing to move the presser foot 9 upward or downward and a speed adjusting knob 20 adjusting a sewing speed or a rotational speed of the sewing machine motor 9. The user manually operates the aforementioned operation keys when the operating device 40 is not connected to the sewing machine body 1.

A large-sized vertically long liquid crystal display (LCD) 21 capable of full-color display is mounted on the front of the pillar 3. The LCD 21 as a surface on which a touch panel 2 is mounted. When depressing the touch panel 22, the user can select a desired ordinary pattern or embroidery pattern or can cause the sewing machine to execute various functions.

FIG. 2 schematically illustrates an electrical arrangement of the sewing machine body 1. A control device 25 controlling the whole sewing machine body 1 is mainly composed of a microcomputer. More specifically, the control device 25 includes a CPU 26, a ROM 27, a RAM 28, an EEPROM 29, an input interface 30, an output interface 31 and a USB interface 32, all of which are connected to one another by a bus 33. The ROM 27 stores a control program for controlling a sewing operation and various data inclusive of stitch data necessary for the sewing operation.

To the input interface 30 are connected the main shaft angle detector 13, the touch panel 22, the start/stop key 15, the backstitch key 16, the needle up/down key 17, the thread cutting key 18, the presser up/down key 19 and the speed adjusting knob 20. When operated, these detector, panel, knob and keys generate respective operation signals, which are supplied to the control device 25. The LCD 21 is connected via a drive circuit 34 to the output interface 31. The sewing machine motor 11, the needle swing pulse motor 12, the presser drive motor 10 and the thread cutting motor 14 are connected via respective drive circuits 35, 36, 37 and 38 to the output interface 31. The control device 25 then controls these motors to execute the sewing operation. A connector 24 is also connected to the output interface 31.

The control device 25 and that is, the CPU 26 each have a USB host function and are provided with a USB connector (or port) 39 connected to the USB interface 32. The USB connector 39 is provided in a right side wall of the pillar 3 of the sewing machine body 1 as shown in FIG. 1. The operating device 40 is detachably connected to the USB connector 39. The operating device 40 generates an operation signal according to an action of user's foot, as will be described later.

The control device 25 reads the operating signals generated by the operating device 40 to execute processing according to the operation signals while the operating device 40 is connected to the sewing machine body 1. More specifically, the control device 25 executes control for start or stop of a sewing operation of the sewing machine motor 11, a sewing speed or adjustment of a rotational speed of the sewing machine motor 11, an operation for switching the stop position of the needle bar 6 between the needle-up and the needle-down, the backstitch operation, a thread cutting operation by the automatic thread cutting mechanism and a raising or lowering operation of the presser foot 9 by the presser drive mechanism.

Figure 3C:
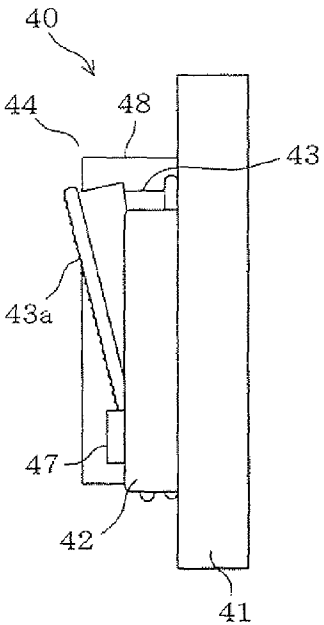
FIGS. 3A, 3B and 3C are plan, front and right side views of the sewing machine operating device respectively.
Figure 3A:
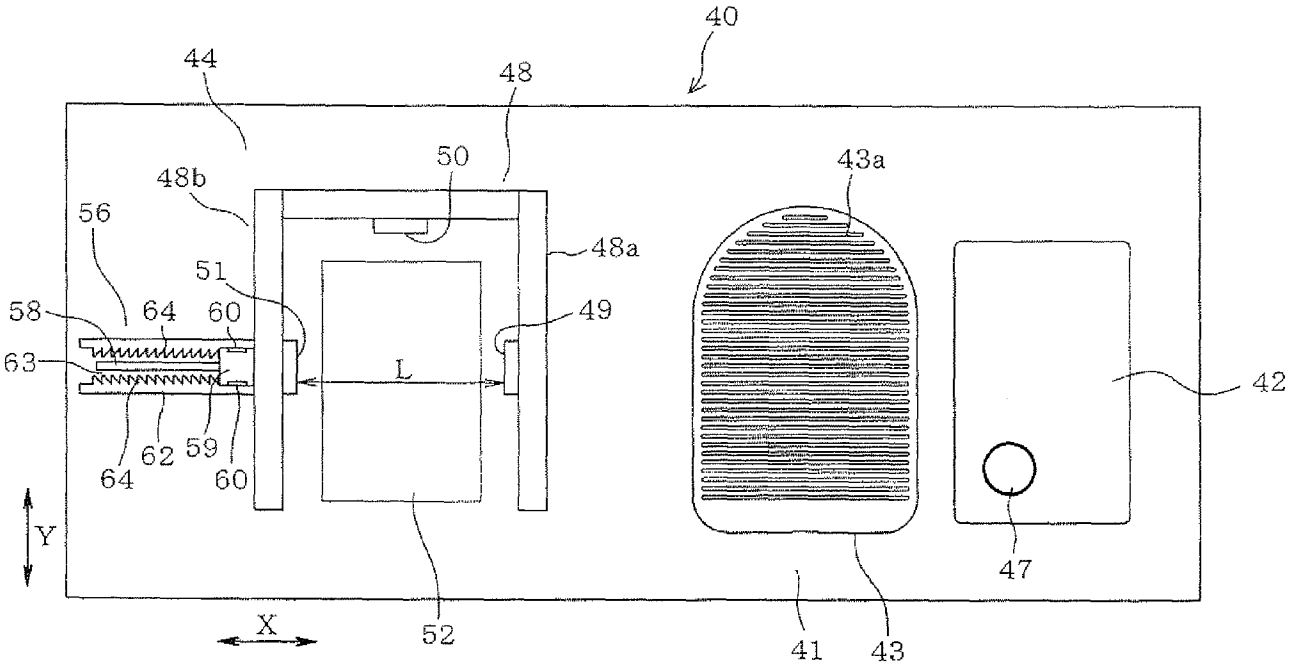
Figure 3B:
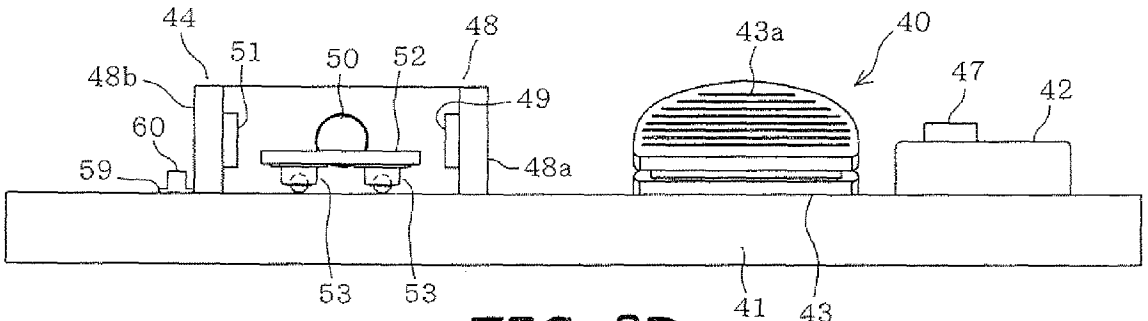

The operating device 40 will now be described in detail with further reference to FIGS. 3A to 6 as well as with FIGS. 1 and 2. An overall appearance of the operating device 40 is shown in FIGS. 3A to 3C. The operating device 40 includes a base 41, a control box 42, a pedal device 43 and a switch operation portion 44. The base 41 is formed into an oblong rectangular flat shape and has an upper surface on which the control box 42, the pedal device 43 and the switch operation portion 44 are provided sequentially from the right. The sewing machine body 1 is placed on a working table or a working desk, and the operating device 40 is placed on the floor, namely, under foot of the user although the arrangement is not shown. The user sits on a chair (not shown) to operate the operating device 40 by his/her foot.

Figure 6:
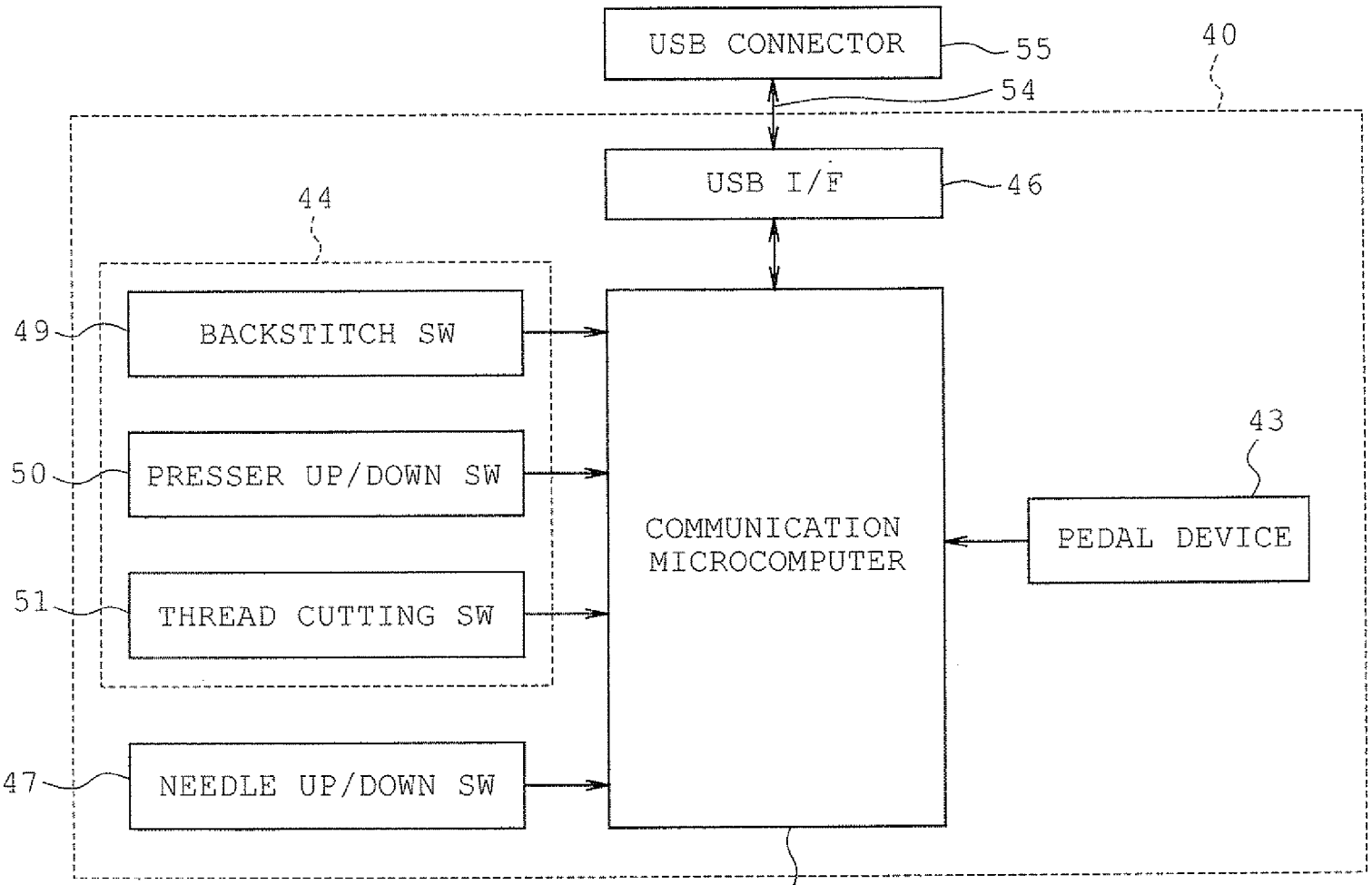
FIG. 6 is a schematic block diagram showing an electrical arrangement of the sewing machine operating device.

The pedal device 43 includes an actuating portion 43*a* which is pressed by user's foot (a right foot, in this case) and a variable resistor (not shown) which varies a resistance value thereof according to an amount of press applied to the actuating portion 43*a*. The pedal device 43 delivers a voltage signal presenting an administrative distance (AD) value according to the press amount of the actuating portion 43*a*. The control box 42 is formed into the shape of a thin rectangular box and houses a circuit board provided with a communication microcomputer 45, a USB interface 46 and the like as shown in FIG. 6. A needle up/down switch 47 serving as an operating member is mounted on an upper surface of the control box 42 and comprises a push-button switch. The needle up/down switch 47 instructs to switch a stop position of the needle bar 6 between needle-up and needle-down. The needle up/down switch 47 is pressed downward by a sole of the user's right foot.

Figure 5A:
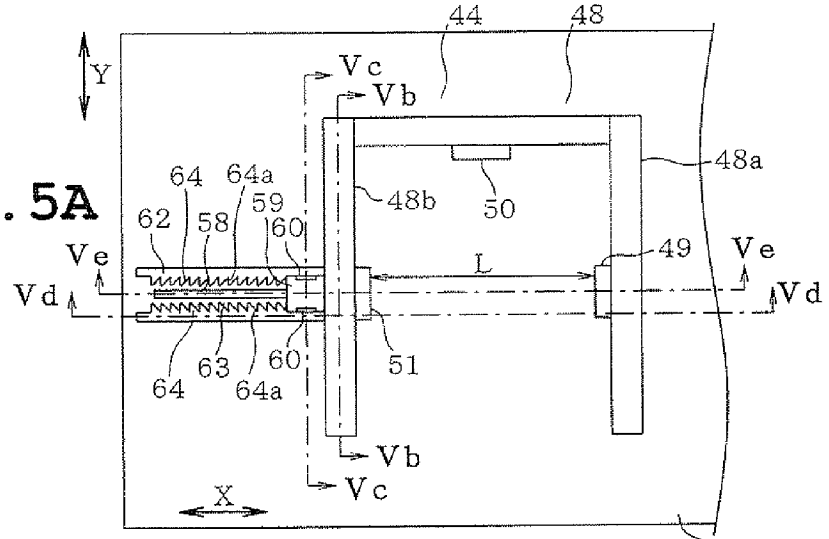
FIG. 5A is a plan view of switch operating portion and FIGS. 5B, 5C, 5D and 5E are longitudinal side sections taken along lines Vb-Vb, Vc-Vc, Vd-Vd and Ve-Ve in FIG. 5A respectively.

On the other hand, the switch operation portion 44 is operated by the user's left foot and configured as follows. The base 41 is formed with a rising wall 48 including a right wall, a rear wall and a left wall and an open front, as shown in FIGS. 1, 3A, 5A, etc. A space defined inside the rising wall 48 is large enough to accommodate the user's left foot. In the embodiment, the rising wall 48 includes an L-shaped fixed wall 48*a* composing the right and rear walls and a movable wall 48*b* composing the left wall. The fixed wall 48*a* is fixed to the base 41. The movable wall 48*b* is configured to be movable in the X direction or the right-left direction, that is, to be displaceable.

The right, left and rear walls of the rising wall 48 are provided with a plurality of, or in the embodiment, three operating members 49, 51 and 50 respectively. More specifically, the backstitch switch 49 instructing the backstitching is provided on an inner wall surface of the right wall or the fixed wall 48*a* as shown in FIGS. 3A, 3B and the like. The presser up/down switch 50 instructing rise or lowering of the presser foot 9 is provided on an inner wall surface of the rear wall of the fixed wall 48*a*. The thread cutting switch 51 instructing a thread cutting operation is provided on an inner wall surface of the left wall or the movable wall 48*b*. The three switches 49 to 51 include respective push-button switches the user presses with his/her toe, the right or left side of his/her foot. The backstitch switch 49 and the thread cutting switch 51 are disposed so as to be opposed to each other with user's foot or a placement pedestal 52 being sideways interposed therebetween.

Figure 4A:
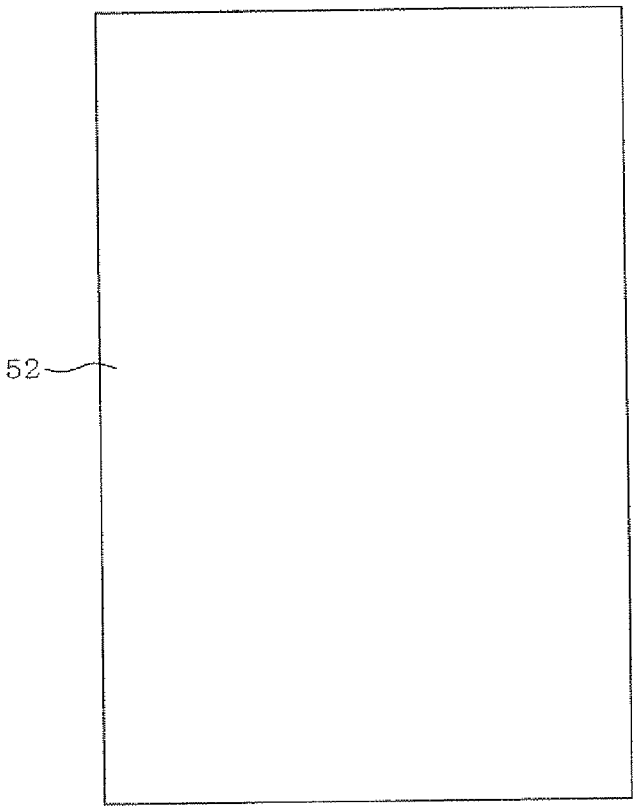
FIGS. 4A, 4B and 4C are plan, front and right side views of a placement pedestal respectively.
Figure 4C:
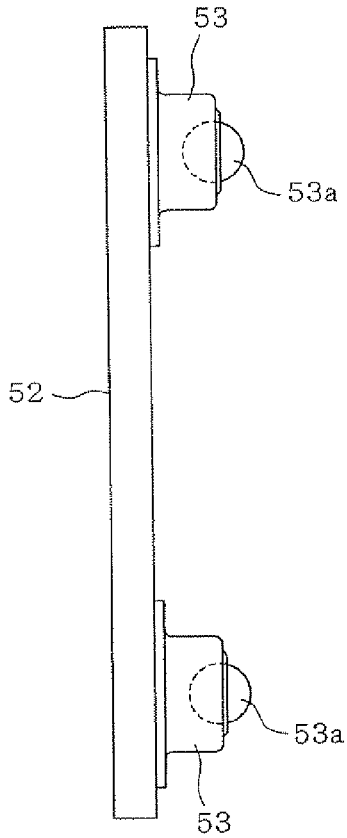
Figure 4B:
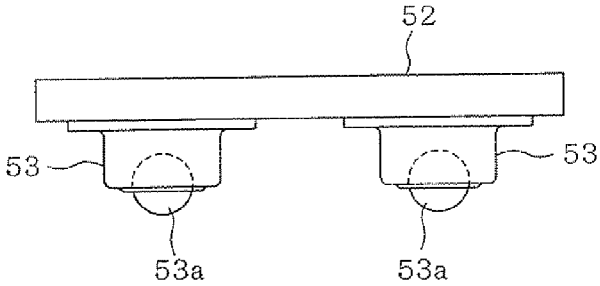

The aforementioned placement pedestal 52 is disposed in the space inside the rising wall 48 on the base 41 as shown in FIGS. 1, 3A and 3B. The user's foot or more specifically, the user's left foot is placed on the placement pedestal 52. The placement pedestal 52 is formed into the shape of a rectangular flat plate which is slightly longer in the Y direction. The placement pedestal 52 is set so as to be smaller than the space inside the rising wall 48 and slightly larger than user's foot. The placement pedestal 52 has an underside provided with four casters 53 located at four corners respectively. Each caster 53 is constituted by a ball caster including a ball 53*a* which serves as a rotating body and is mounted so as to be omnidirectionally rotatable so that a part of the ball 53*a* projects below a caster body, as shown in FIGS. 4A and 4C. When the ball 53*a* of the caster 53 rolls freely on the base 41, the placement pedestal 52 is supported so as to be movable in any direction in the space inside the rising wall 48 with user's foot being placed thereon. Furthermore, the switches 49 to 51 are located at such respective heightwise positions that the user can depress the switches 49 to 51 with his/her toe or right or left side of the foot while placing the foot on the placement pedestal 52, as shown in FIG. 3B. The switches 49 to 51 serve as detectors which detect, by means of contact, that user's foot is located at one of a plurality of different predetermined positions or more specifically, at a position where any one of the switches 49 to 51 is depressed.

The movable wall 48*b* on which the thread cutting switch 51 is mounted is provided so that the position thereof is adjustable in the right-left direction as described above. More specifically, a distance L between the backstitch switch 49 and the thread cutting switch 51 or a distance between the right and left walls of the rising wall 48 is adjustable so as to be increased or decreased as shown in FIGS. 3A and 5A. A distance adjusting mechanism 56 provided on the left of the movable wall 48*b* of the switch operation portion 44 will now be described with reference to FIGS. 5A to 5E. The distance adjusting mechanism 56 is provided for adjusting the position of the thread cutting switch 51 with respect to the right-left direction or the distance L between the thread cutting switch 51 and the backstitch switch 49 by changing the position of the movable wall 48*b* with respect to the right-left direction.

More specifically, the movable wall 48*b* is provided on the upper surface of the base 41 so as to extend in the front-back direction (the Y direction), as shown in FIGS. 5A to 5E. The movable wall 48*b* has a guide portion 57 which is formed integrally with a central bottom thereof so as to protrude downward, as shown in FIGS. 5B to 5E. A guide portion 57 has a lower end formed with a flange or a head having a larger diameter. The base 41 is provided with a guide groove 58 which extends in the right-left direction and engages the guide portion 57. The lower end flange of the guide portion 57 serves to prevent the guide portion 57 and accordingly the movable wall 48*b* from dropping out of the guide groove 58 upward. Thus, when the guide portion 57 is inserted through the guide groove 58 so as to be prevented from dropping off, the movable wall 48*b* is guided by the guide groove 58 thereby to be supported so as to be movable in the right-left direction relative to the base 41. The support mechanism is thus constructed as described above.

The movable wall 48*b* is supported so as to be movable in the right-left or X direction between a right end position where a right wall of the rear end thereof is in contact with the fixed wall 48*a* as shown in FIG. 5A and a left end position near the right side of the base 41. A part of the base 41 around the guide groove 58 is formed into a recess open to the underside. The recess serves as a thinner portion or slide block which will be described later.

The outer wall of the movable wall 48*b* has a central lower portion of the leftwardly directed side thereof as shown in FIGS. 3A, 5A, 5C to 5E. The central lower portion has a rectangular thin slide plate 59 formed integrally therewith. Furthermore, the slide plate 59 protrudes toward the outer side surface or horizontally leftward. The slide plate 59 includes front and rear sides thereof, and upwardly extending rectangular manually operated portions 60 are formed integrally with central parts of the front and rear sides of the slide plate 59 respectively. With the manually operated portions 60, two engagement claws 61 are formed integrally on central portions of the front and rear ides of the slide plate 59 respectively.

In the above-described case, the front side manually operated portion 60 and the engagement claw 61 are formed into a single plate extending upward and downward. The rear side manually operated portion 60 and engagement claw 61 are also formed into a single plate extending upward and downward. As a result, the manually operation portion 60 and the engagement claw 61 have an H-shaped side together with the slide plate 59 as shown in FIG. 5C. The user pinches the two manually operated portions 61 to elastically deform the portions 61 so that the distance between the portions 61 is increased inward or in the direction of arrow F as shown in FIG. 5C. Consequently, the engagement claws 61 are disengaged from the engagement recesses respectively as will be described later. In this case, the slide plate 59 is elastic and accordingly serves as a biasing member.

Figure 5D:
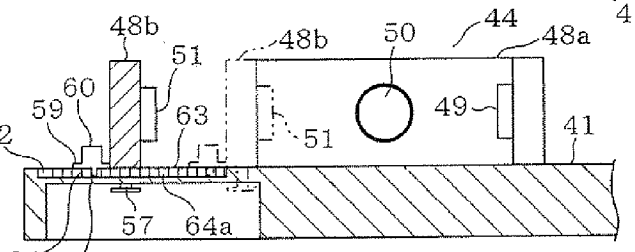
Figure 5E:
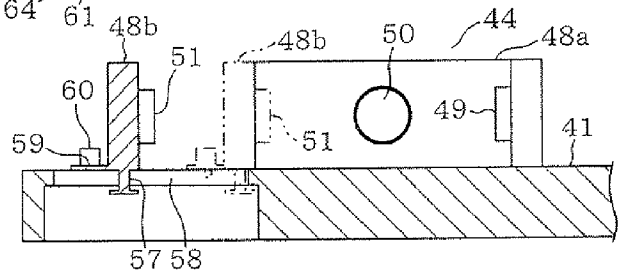
Figure 5B:
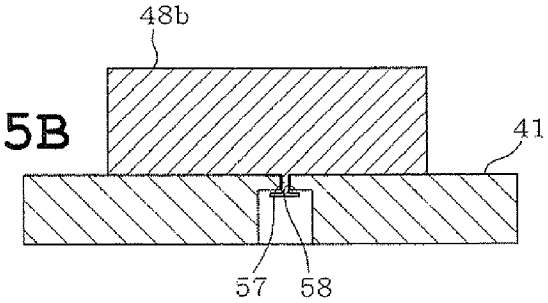
Figure 5C:
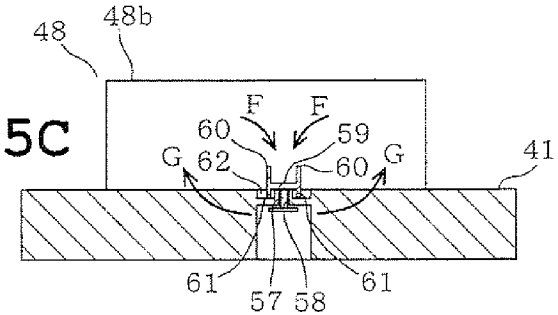

On the other hand, the base 41 has a recess 62 extending leftward from a central portion of the movable wall 48*b* located at the right end position, with respect to the front-back direction as shown in FIGS. 5A, 5C and 5D. With the recess 62, an oblong rectangular slide block 63 extending in the right-left direction is located in the recess 62. The slide block 63 has an upper surface which is coplanar with the upper surface of the base 41. The slide plate 59 is adapted to be slid on the upper surface of the slide block 63 in a placed state. Additionally, the guide groove 58 is formed in the middle portion of the slide block 63 with respect to the Y direction, extending in the X direction, as shown in FIG. 5A. The guide groove 5 is formed vertically through the slide block 63 as viewed in FIGS. 5C to 5E.

The slide block 63 has front and rear sides or outer walls formed with respective engagement holding portions 64 each of which has a plurality of engagement recesses 64*a* aligned in the X direction. The slide plate 59 has front and rear engagement claws 61 which are adapted to be engaged with the engagement recesses 64*a*. The engagement holding portions 64 are opposed to each other in the Y direction so that the engagement recesses 64*a* are arranged into a saw-toothed shape as viewed from above.

The engagement claws 61 of the slide plate 59 are selectively engaged with respective one of the engagement recesses 64*a* of the holding portions 64, whereby the movable wall 48*b* and accordingly the thread cutting switch 51 are positioned with respect to the X direction. In this case, the engagement claws 61 are biased by their elastic forces in such a direction that the claws 61 are engaged with the recesses 64*a*, respectively. Thus, when the user operates the manually operated portions 60 against the elastic forces or biasing forces, the claws 61 can be disengaged from the recesses 64*a* respectively. The user then slides the slide plate 59 in the right-left direction thereby to move the movable wall 48*b* and accordingly the thread cutting switch 51 to respective desired positions with respect to the right-left direction. Subsequently, the claws 61 are selectively re-engaged with respective one of the engagement recesses 64*a* of the holding portions 64, whereby the slide plate 59 can be fixed.

FIG. 6 schematically shows an electrical arrangement of the operating device 40. To the communication microcomputer 45 are supplied an output signal generated by the pedal device 43, a signal generated by the needle up/down switch 47 and signals generated by the backstitch switch 49, the presser up/down switch 50 and the thread cutting switch 51 of the switch operation portion 44. A USB interface 46 is connected to the communication microcomputer 45. An electrical cable 54 is connected to the USB interface 46 and has a distal end to which a USB connector 55 is connected.

When the USB connector 55 is connected to the USB connector 39 of the sewing machine body 1 as shown in FIG. 1, the operating device 40 is detachably connected to the control device 25 of the sewing machine body 1, whereby a connecting mechanism is configured which executes communication or data transmission conforming to the USB standards. In this case, the communication microcomputer 45 functions as a signal output unit, which generates an operation signal according to operation of the pedal device 43 and delivers the operation signal to the sewing machine body 1 side, the needle-up/down switch 47, the backstitch switch 49, the presser-up/down switch 50 and the thread cutting switch 51. Drive power for the operating device 40 is supplied via the USB connector 55 from the sewing machine 1 side.

The working of the sewing machine constructed above will be described as follows with reference to FIGS. 7 and 8 as well as FIGS. 1 to 6. The user firstly places the operating device 40 at his/her feet when desiring to do sewing with the use of the sewing machine body 1. The user then connects the USB connector 55 to the USB connector (port) of the sewing machine body 1, so that the operating device 40 can be used. In this case, when manipulating the operating device 40 with his/her foot, the user can carry out various operations for the sewing operation while holding the workpiece cloth as an object to be sewn with both hands. More specifically, the sewing machine motor 11 can be started up when the user puts his/her right foot on the actuating portion 43*a* of the pedal device 43 and pressing the actuating portion 43*a* downward. Furthermore, the sewing machine motor 11 can be stopped when the user takes his/her right foot off the actuating portion 43*a*. Additionally, a sewing speed or a rotational speed of the sewing machine motor 11 can be adjusted by adjustment of an amount of pressure against the actuating portion 43*a*.

Furthermore, the user can switch a stop position of the needle bar 6 to the needle-up position or the needle-down position when depressing the needle up/down switch 47 with his/her right foot. More specifically, when the needle up/down switch 47 is depressed downward while the needle bar 6 is stopped at the needle-down position, the needle bar 6 is moved from the needle-down position to the needle-up position. On the contrary, when the needle up/down switch 47 is depressed downward while the needle bar 6 is stopped at the needle-up position, the needle bar 6 is moved from the needle-up position to the needle-down position.

The user can depress each one of the switches 49 to 51 of the switch operation portion 44 when putting his/her left foot on the placement pedestal 52 and then displacing the left foot while the left foot is kept on the placement pedestal 52. In this case, the four casters 53 having the respective balls 53*a* freely rolling on the upper surface of the base 41 are mounted on the bottom of the placement pedestal 52. Accordingly, the placement pedestal 52 can be moved smoothly by application of a small force. As a result, the user can easily move his/her left foot put on the placement pedestal 52, in any direction and to any position.

In the above-described case, the user can instruct the backstitch operation when moving the left foot rightward and depressing the backstitch switch 49 with the right side of the left foot. Furthermore, the user can instruct an operation to move the presser foot 9 upward or downward when moving the left foot rearward to press the presser up/down switch 50 with the toe of his/her left foot. Thus, when the presser up/down switch 50 is depressed while the presser foot 9 is located at the lower position, the presser foot 9 is moved from the lower position to the upper position. On the contrary, when the presser up/down switch 50 is depressed while the presser foot 9 is located at the upper position, the presser foot 9 is moved from the upper position to the lower position. Additionally, the user can instruct a thread cutting operation when moving his/her left foot leftward to depress the thread cutting switch 51 with the left side of his/her left foot.

The left movable wall 48*b* or the thread cutting switch 51 can be changed between the right and left positions according to user's request as the result of provision of the distance adjusting mechanism 56 which adjusts the position of the left movable wall 48*b* or the thread cutting switch 51 with respect to the right-left direction, as described above. For example, the distance between the two switches 49 and 51 or between the right and left walls is increased when the user has big feet. The distance between the switches 49 and 51 is reduced when the user has small feet. Thus, the switches 49 and 51 can be disposed according to the size of the user's feet and can accordingly be located at respective suitable positions where the user can easily operate these switches.

When the operating device 40 is connected to the sewing machine, the control device 25 of the sewing machine body 1 monitors an operation signal supplied thereto from the sewing machine operating device 40 to execute a processing according to the signal. FIG. 7 is a flowchart showing a procedure of periodic timer processing such as loading of operation signals generated by the operating device 40. FIG. 8 is a flowchart showing detailed procedure of a matrix processing at step S13 in the flowchart of FIG. 7.

Figure 7:
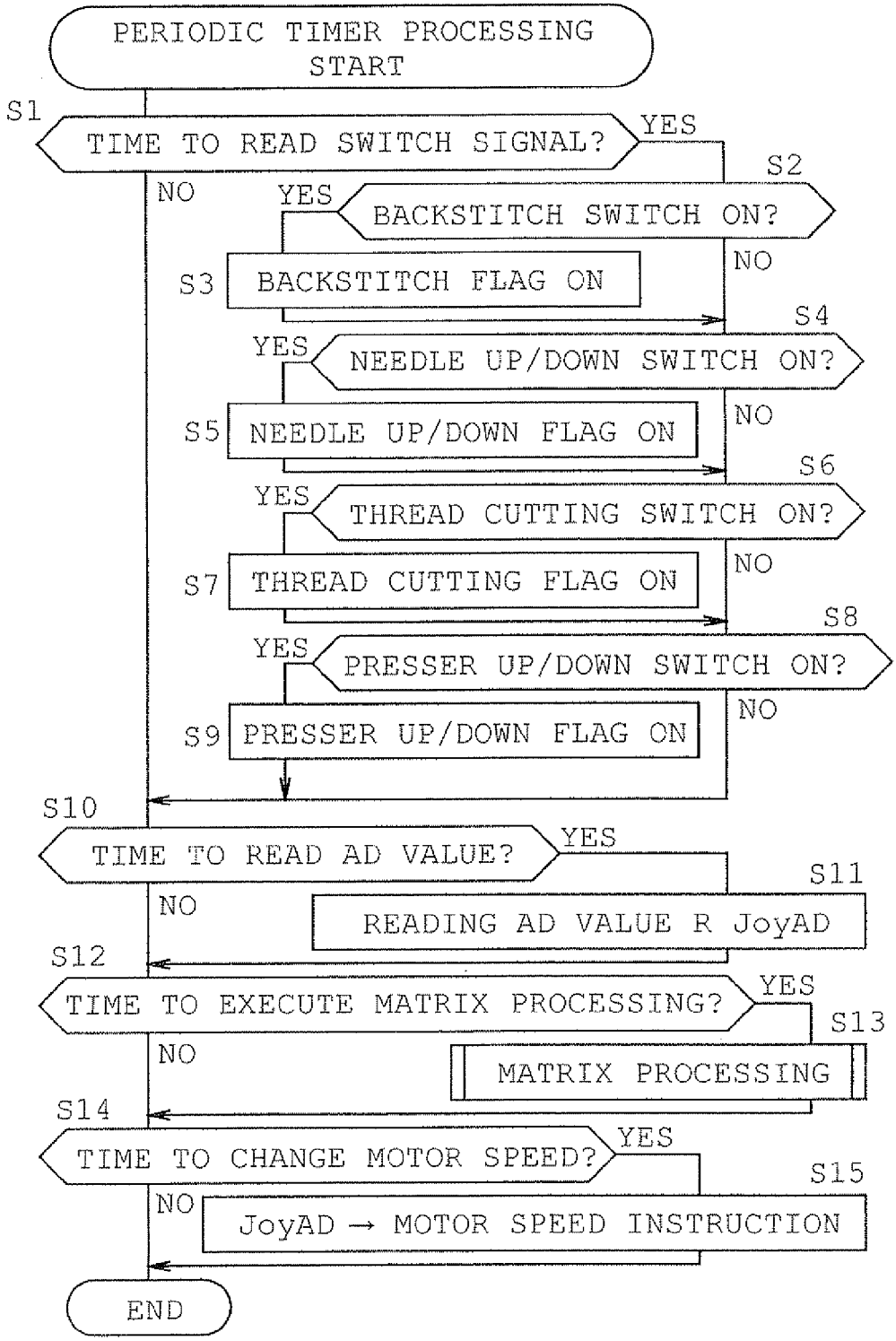
FIG. 7 is a flowchart showing a processing procedure of operation of the sewing machine operating device executed by a control device provided in a sewing machine body.

Upon start of the periodic timer processing in FIG. 7, the control device 25 determines at step S1 whether or not it is time to read a switch signal. The control device 25 proceeds to step S10 when it is not time to read the switch signal (NO at step S1). When it is time to read the switch signal (YES at step S1), the control device 25 proceeds to step S2 to determine whether or not the backstitch switch 49 has been turned on. The control device 25 proceeds to step S4 when the backstitch switch 49 has not been tuned on (NO at step S22). When the backstitch switch 49 has been turned on (YES at step S2), the control device 25 proceeds to step S3 to turn on the backstitch flag, thereafter proceeding to step S4.

The control device 25 determines at step S4 whether or not the needle up/down switch 47 has been turned on. When the needle up/down switch 47 has not been turned on (NO at step S4), the control device 25 proceeds to step S6. When the needle up/down switch 47 has been turned on (YES at step S4), the control device 25 proceeds to step S5 to turn on a needle up/down flag, further proceeding to step S6. The control device 25 determines at step S6 whether or not the thread cutting switch 51 has been operated. When the thread cutting switch 51 has not been turned on (NO at step S6), the control device 25 proceeds to step S8. When the thread cutting switch 51 has been operated (YES at step S6), the control device 25 proceeds to step S7 to turn on the thread cutting flag, thereafter proceeding to step S8.

The control device 25 determines at step S8 whether or not the presser up/down switch 50 has been turned on. When the presser up/down switch 50 has not been turned on (NO at step S8), the control device 25 proceeds to step S10. When the presser up/down switch 50 has been turned on (YES at step S8), the control device 25 proceeds to step S9 to turn on a presser up/down flag, proceeding to step S10. The control device 25 determines at step S10 whether or not it is time to read an output signal (AD value) of the pedal device 43. The control device 25 proceeds to step S12 when it is not time to read the AD value (NO at step S10). When it is time to load the AD value (YES at step S10), the control device 25 proceeds to step S11 to read the AD value and set a variable JoyAD to the AD value, thereafter proceeding to step S12.

The control device 25 determines at step S12 whether it is time to execute a matrix processing. The control device 25 proceeds to step S14 when it is not time to execute the matrix processing (NO at step S12). When it is time to execute the matrix processing (YES at step S12), the control device 25 proceeds to step S13 to execute the matrix processing, thereafter proceeding to step S14. The control device 25 determines at step S14 whether or not it is time to change a motor speed. The control device 25 ends processing when it is not time to change the motor speed (NO at step S14). When it is time to change the motor speed (YES at step S14), the control device 25 proceeds to step S15 to instruct a motor speed based on the value of a variable JoyAD, ending the processing.

Next, the matrix processing at step S13 in FIG. 7 will be described in more detail with reference to the flowchart of FIG. 8. The control device 25 determines at step S21 whether or not the backstitch flag is on. When the backstitch flag is on (YES at step S21), the control device 25 proceeds to step S22 to execute the backstitch, thereafter ending the processing or returning. When the backstitch flag is not on (NO at step S21), the control device 25 proceeds to step S23 to determine whether or not the needle up/down flag is on. When the needle up/down flag is on (YES at step S23), the control device 25 proceeds to step S24 to execute switching the stop position of the needle bar 6 between the needle-up position and the needle-down position, thereafter ending the processing.

When the needle up/down flag is not on (NO at step S23), the control device 25 proceeds to step S25 to determine whether or not a thread cutting flag is on. When the thread cutting flag is on (YES at step S25), the control device 25 proceeds to step S26 to cause the automatic thread cutting mechanism to execute the thread cutting, thereafter ending the processing. When the thread cutting flag is not on (NO at step S25), the control device 25 proceeds to step S27 to determine whether or not a presser up/down flag is on. When the presser up/down flag is on (YES at step S27), the control device 25 proceeds to step S28 to cause the presser driving mechanism to move the presser foot 9 upward or downward, thereafter ending the processing. When the presser up/down flag is not on (NO at step S27), the control device 25 ends the processing.

Figure 8:
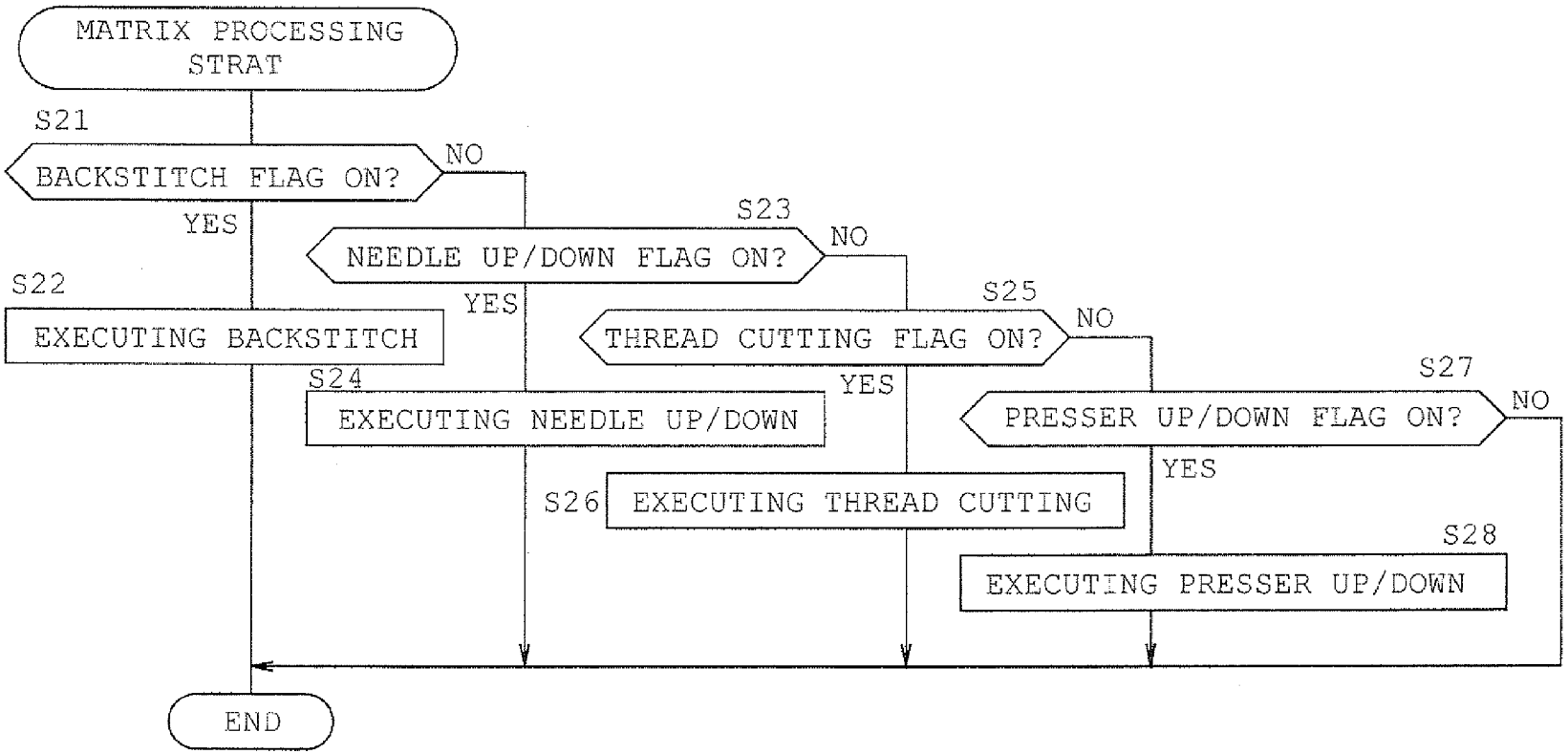
FIG. 8 is a flowchart showing a detailed processing procedure of step S13 in FIG. 7.

Even when a plurality of switches 49 to 52 of the switch operation portion 44 is simultaneously turned on as the result of processing as shown in FIG. 8, only the operation assigned with higher priority or a smaller step number is effected, whereupon simultaneous execution of two operations can be prevented.

According to the above-described operating device 40, the switch operation portion 44 is provided which has the backstitch switch 49, the presser up/down switch 50 and the thread cutting switch 51 all of which are operated by user's foot. With this, the distance adjusting mechanism 56 is provided for adjusting the side position of the movable wall 48*b* on which the thread cutting switch 51 is mounted. As a result, the distance between the backstitch switch 49 and the thread cutting switch can be adjusted to user's foot size. Accordingly, the operability of the operating device 40 can be improved irrespective of user's foot size.

In the foregoing embodiment, the distance adjusting mechanism 56 serving as the position adjusting mechanism changes the position of the movable wall 48*b* or the thread cutting switch 51 thereby to adjust the distance between the backstitch switch 49 and the thread cutting switch 51 in the increasing or decreasing direction. This can simplify the adjusting work. Furthermore, the manually operated portions 60 are operated so that the engagement claw 61 is disengaged from the engagement recess 64*a*, whereby the movable wall 48*b* is slid in the right-left direction. Subsequently, when the engagement claw 61 is selectively re-engaged with one of the engagement recesses 64*a*, the movable wall 48*b* is fixed in position. Thus, the distance between the backstitch switch 49 and the thread cutting switch 51 can be adjusted by a simple operation.

Moreover, in the foregoing embodiment, the placement pedestal 52 onto which user's foot is to be put is disposed so as to be freely movable in any direction by the casters 53. Thus, the placement pedestal 52 is configured to be displaced while user's foot is retained on the placement pedestal 52. Consequently, the placement pedestal 52 can be moved smoothly by a simplified structure with a smaller force being applied thereto. This results in further improvement in the operability of the switch operation portion by user's foot.

Additionally, the operating device 40 employs the connecting mechanism using the communication conforming to the USB standards. As a result, the operating device 40 can be connected to all sewing machines provided with respective USB connectors 39, whereupon the versatility of the operating device 40 can be improved. When the operating device 40 is connected to a personal computer, various settings and rewriting of data set in the operating device 40 can be executed with the use of the personal computer. It is needless to say that the advantageous effects of the USB standards such as high-speed data transfer can be achieved.

Second and third embodiments and modified forms will be described as follows. The second and third embodiments are also directed to the operating device which is connected to the sewing machine body 1 as in the first embodiment. The modified forms are derived from the first embodiment. Identical or similar parts in the second and third embodiments and in the modified forms are labeled by the same reference symbols as those in the first embodiment, and the description of these parts will be eliminated. The following describes only the difference between the first embodiment and the second and third embodiments and the modified forms.

Figure 9A:
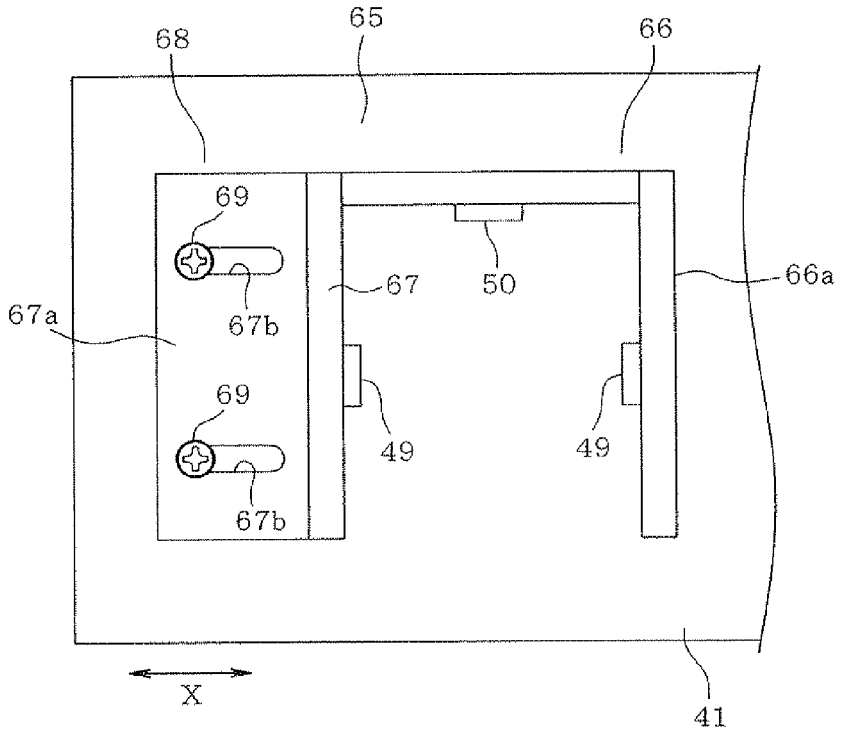
FIGS. 9A and 9B are plan views of the operating portion for the sewing machine according to a second embodiment with a distance between right and left switches being decreased and increased respectively.
Figure 9B:
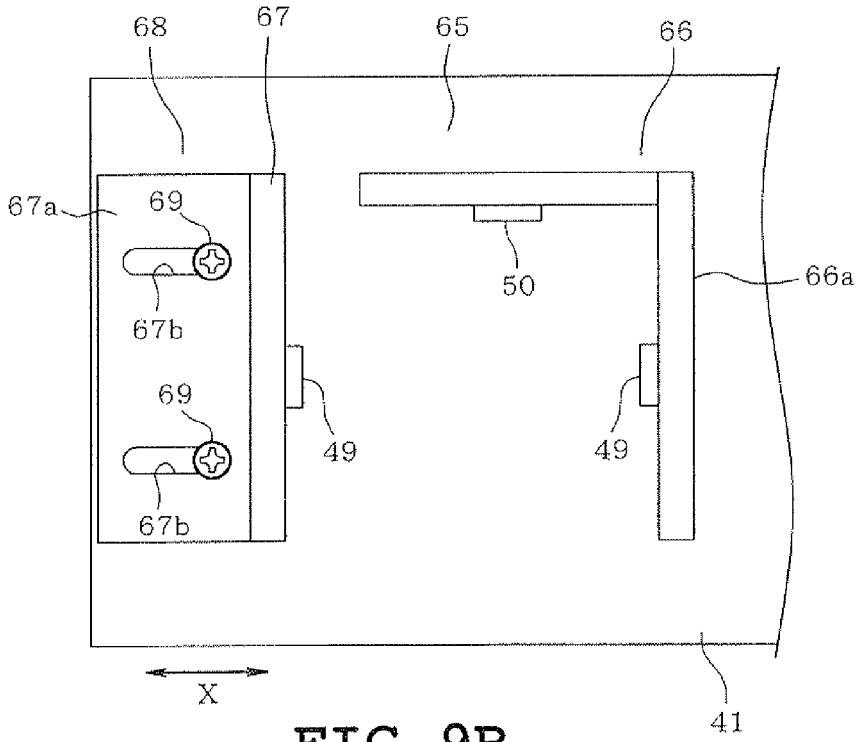
Figure 10:
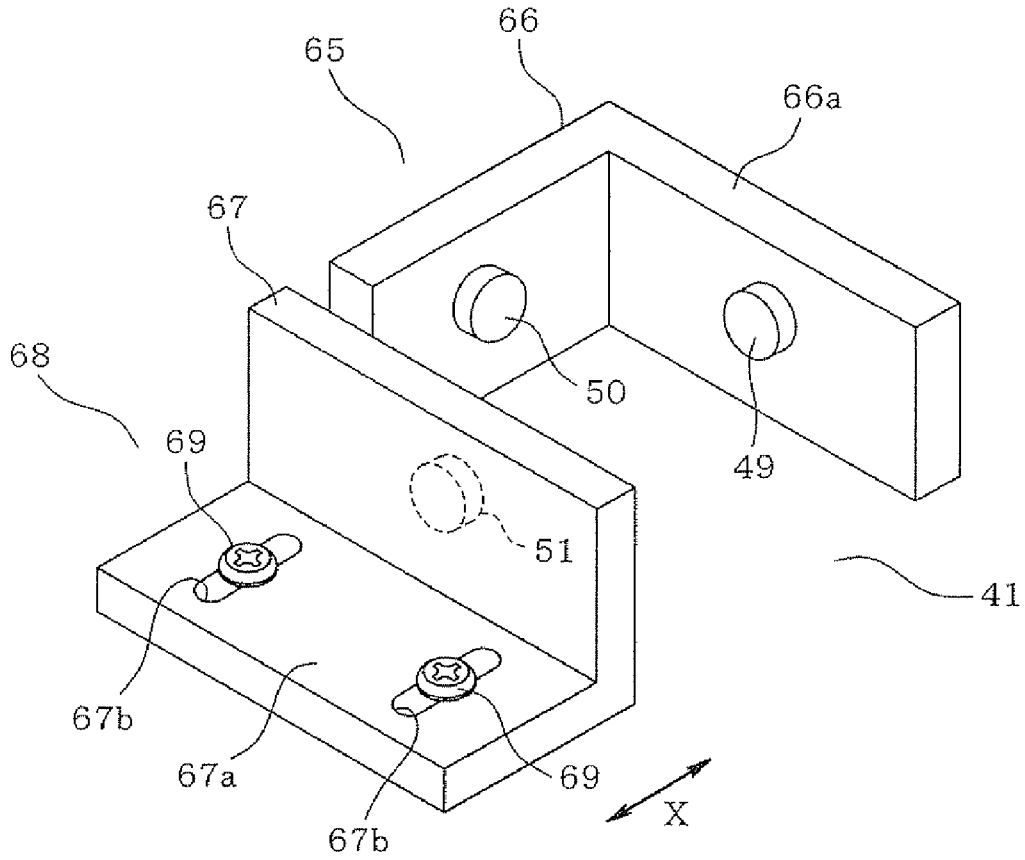
FIG. 10 is a perspective view of the switch operating portion.

FIGS. 9A, 9B and 10 illustrate the second embodiment. The second embodiment differs from the first embodiment in a switch operating portion 65 provided on the base 41 of the operating device. The switch operating portion 65 has a rising wall 66 having an open front. The backstitch switch 49, the presser up/down switch 50 and the thread cutting switch 51 are provided on the right wall, the rear wall and the left wall of the rising wall 66 respectively.

The rising wall 66 includes a generally L-shaped fixed wall 66*a* constituting the right and rear walls as viewed in a plan view. The rising wall 66 also includes a movable wall 67 constituting the left wall. The movable wall 67 serves as the support pedestal and includes a mounting plate 67*a* which is formed integrally therewith and horizontally extends leftward from a lower long side thereof such that the movable wall 67 has a generally L-shaped section. The movable wall 67 is mounted so that the mounting plate 67*a* thereof is placed on the base 41. In this case, the movable wall 67 is displaceable or movable in the right-left or X direction as viewed in FIG. 10, so that the position of the movable wall 67 is adjusted with respect to the right-left direction by the distance adjusting mechanism 68 serving as the position adjusting mechanism.

More specifically, the distance adjusting mechanism 68 is constructed as follows. The mounting plate 67*a* has two elongate screw-insertion holes 67*b* extending in the right-left direction. The base 41 has two screw holes, which are not shown. Two screw members 69 are screwed through the elongate holes 67*a* into the screw holes respectively, whereby the movable wall 67 is fixed to the base 41. Thus, the movable wall 67 is fixed when the screw members 69 are tightened up. When the screw members 69 are loosened, the relative movement of the screw members 69 is allowed within the respective elongate holes 67*b*, whereupon the movable wall 67 is slidable in the right-left direction. The user then loosens the screw members 69 to slide the movable wall 67 in the right-left direction to a desirable position. Thereafter, the user tightens up the screw members 69 to fix the movable wall 67.

In the second embodiment, too, the operating device is provided with the switch operating portion 65 having the backstitch switch 49, the presser up/down switch 50, the thread cutting switch 51 all of which are operated by user's foot as in the first embodiment. The operating device is further provided with the distance adjusting mechanism 68 on which the thread cutting switch 51 is provided and which adjusts the position of the movable wall 67 with respect to the right-left direction. Consequently, the distance between the backstitch switch 49 and the thread cutting switch 51 can be adjusted according to user's foot size. Accordingly, the operability of the operating device can be improved irrespective of user's foot size. Furthermore, since the distance adjusting mechanism 68 comprises the elongate holes 67*b* and the screw members 69 in the second embodiment, an economical operating device having a simple configuration can be realized.

Although the distance adjusting mechanism 68 has the elongate holes 67*b* formed at the movable wall side in the second embodiment, the distance adjusting mechanism 68 may be constructed as follows. The screw insertion holes may be provided in the mounting plate 67*a* of the movable wall 67, and the elongate holes which are long with respect to the right-left direction. The movable wall 67 may be mounted so as to be displaceable by inserting the screw members 69 through the screw insertion holes and the elongate holes and tightening up nut members which are disposed on the underside of the mounting plate 67*a* so as to correspond to the elongate holes, respectively.

Figure 11C:
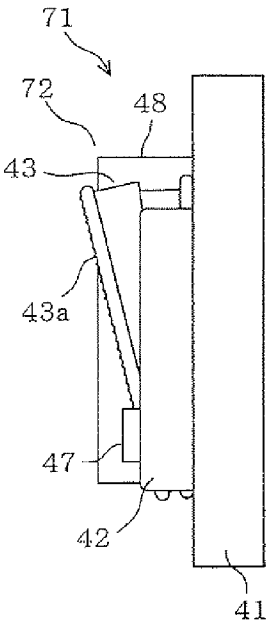
FIGS. 11A, 11B and 11C are plan, front and right side views of the operating device according to a third embodiment respectively.
Figure 11A:
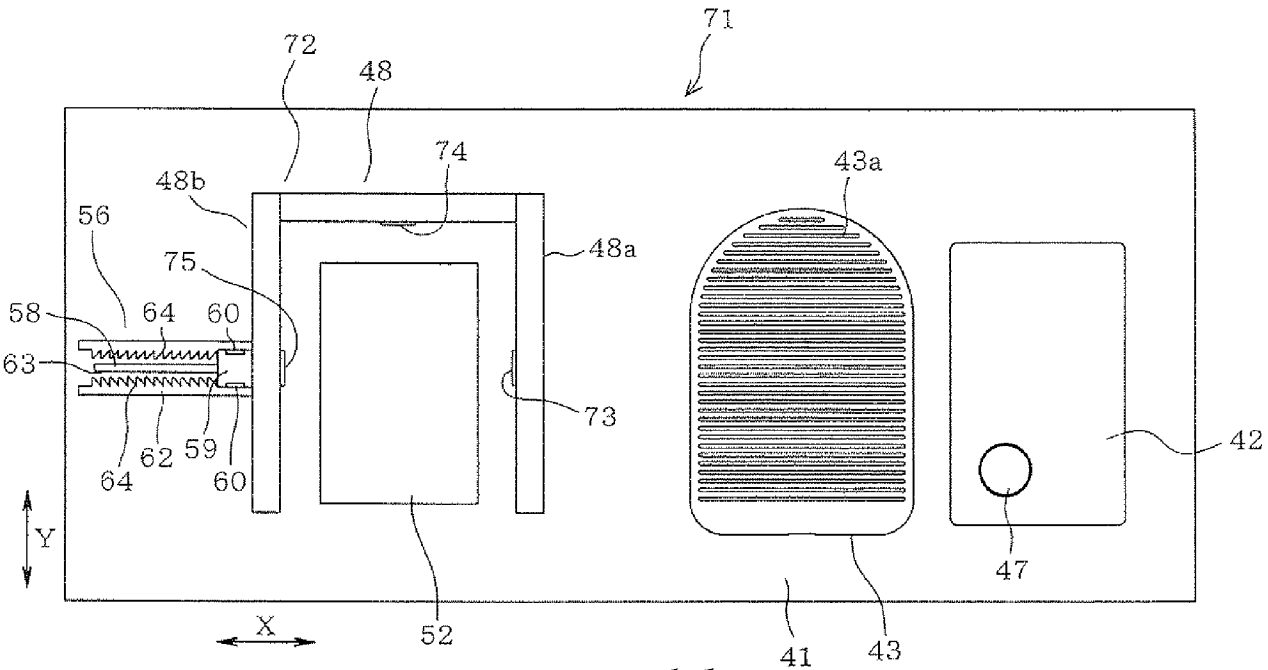
Figure 11B:
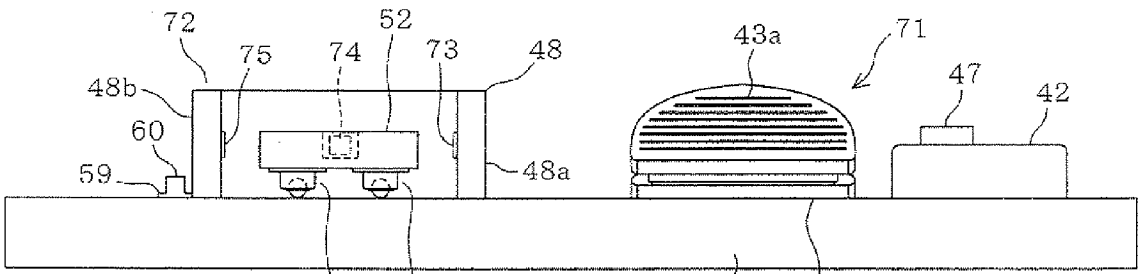

FIGS. 11A to 11C illustrate the third embodiment. The operating device 71 of the third embodiment differs from the operating device 40 of the first embodiment in the configuration of the switch operating portion 72. The switch operating portion 72 is provided with a backstitch sensor 73, a presser up/down sensor 74 and a thread cutting sensor 75 all of which are provided on inner wall surfaces of the right, rear and left walls of the rising wall 48 and comprise optical sensors, respectively. Each sensor serves a detector which detects the action of user's foot in a non-contact manner.

Each one of the sensors 73 to 75 comprises a reflective photosensor (not shown) having a light emitting portion and a light receiving portion both of which are juxtaposed to each other. Each reflective photosensor is configured to emit light which is reflected on a surface of an object to be received by the light receiving portion, thereby detecting proximity of the object, as well known in the art. In the embodiment, the side surfaces of the placement pedestal 52 serve as reflecting surfaces which reflect the light emitted from the light emitting portions, respectively. Alternatively, dedicated reflecting plates may be mounted on the sides of the placement pedestal 52 for improvement in the detection accuracy, respectively. Furthermore, the distance adjusting mechanism 56 is provided for adjusting the position of the thread cutting sensor 73 or the left movable wall 48*b* with respect to the right-left direction. As a result, the position of the movable wall 48*b* or the thread cutting sensor 75 can be changed with respect to the right-left direction.

The user moves the placement pedestal 52 with his/her foot being put thereon to cause the right side surface of the placement pedestal 52 to come closer to the backstitch sensor 73. The backstitch sensor 73 then detects the proximity of the placement pedestal 52, so that a backstitch operation is instructed. In the same manner, the placement pedestal 52 is moved rearward so that the rear surface of the placement pedestal 52 is caused to come closer to the presser up/down sensor 74. The presser up/down sensor 74 then detects the proximity of the placement pedestal 52, so that the upward or downward movement of the presser foot 9 is instructed. Furthermore, when the placement pedestal 52 is moved leftward to cause the left side of the placement pedestal 52 to come closer to the thread cutting sensor 75, the thread cutting sensor 75 detects the proximity of the placement pedestal 52, whereupon thread cutting is instructed.

In the third embodiment, too, the operating device 71 is provided with the switch operating portion 72 having the backstitch switch 73, the presser up/down switch 74, the thread cutting sensor 75 all of which are operated by user's foot. The operating device 71 is further provided with the distance adjusting mechanism 56 which adjusts the position of the movable wall 67 provided with the thread cutting sensor 75 with respect to the right-left direction. Consequently, the distance between the backstitch sensor 73 and the thread cutting sensor 75 can be adjusted according to user's foot size. Accordingly, the operability of the operating device can be improved irrespective of user's foot size.

The foregoing embodiments should not be restrictive but may be expanded or modified as follows. For example, in the third embodiment, the reflective photosensors are employed as the detectors which detect the action of user's foot in the non-contact manner. However, an infrared sensor may be provided for detecting infrared rays emitted from a human body, thereby detecting the proximity of user's foot, instead. Furthermore, the operating device includes the pedal device and the four switches or sensors in each of the foregoing embodiments. The number of the switches or sensors may be not less than 5 or not more than 3.

The position adjusting mechanism may include switches or sensors the positions of which are adjustable with respect to the front-back direction, instead. Furthermore, the operating device may be configured so that relative positions of the switch operating portion and the pedal device are adjustable. The layout of the switches on the base may be modified into various forms. For example, the operating device may be configured so that user's toe is put on the base 41 for operation without use of the placement pedestal. Otherwise, various changes may be made in the construction of the sewing machine body, the construction of a connecting mechanism which connects the operating device to the sewing machine body and the construction of the casters of the placement pedestal.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A sewing machine operating device comprising:

a base;

a connecting mechanism that is configured to electrically connect the sewing machine operating device to a sewing machine body;

a plurality of operating members which is mounted on the base and configured to be operated by a user with his/her foot, the operating members having respective detectors that are configured to each detect an action of the foot in a contact or non-contact manner and include at least two detectors which are mounted so as to be opposed to each other while the foot placed on the base can be interposed between the detectors from sides of the foot;

a signal output unit that is configured to generate an operation signal according to operation of each operating member and deliver the operation signal via the connecting mechanism to the sewing machine body; and a position adjusting mechanism that is configured to change a position of at least one of the operating members mounted on the base, the position adjusting mechanism including a distance adjusting mechanism that is configured to adjust a distance between the at least two detectors in an increasing or decreasing direction.

2. The operating device according to claim 1, wherein the distance adjusting mechanism includes:

a support mechanism that is configured to support one of the at least two detectors so that the one detector is slidable in a distance increasing or decreasing direction;

a plurality of engagement recesses which is arranged in a direction of the sliding movement;

an engagement claw which is provided at one detector side to selectively engage with one of the engagement recesses thereby to fix the one detector;

a biasing member that is configured to bias the engagement claw in a direction of engagement with one of the engagement recesses; and a manually operated portion that is configured to disengage the engagement claw from the one of the engagement recesses against a biasing force of the biasing member thereby to allow the engagement claw to move.

3. The operating device according to claim 1, further comprising a support pedestal that is configured to support one of the at least two detectors, wherein the distance adjusting mechanism includes an elongate screw insertion hole which is formed in either the base or the support pedestal so as to extend in a direction of increasing or decreasing the distance and a screw member which fixes the support pedestal at an arbitrary position in the elongate screw insertion hole relative to the base so that the support pedestal is displaceable.

4. A sewing machine comprising:

a sewing machine body; and a sewing machine operating device including:

a base;

a connecting mechanism that is configured to electrically connect the sewing machine operating device to a sewing machine body;

a plurality of operating members which is mounted on the base and configured to be operated by a user with his/her foot, the operating members having respective detectors that are configured to each detect an action of the foot in a contact or non-contact manner and include at least two detectors which are mounted so as to be opposed to each other while the foot placed on the base can be interposed between the detectors from sides of the foot;

a signal output unit that is configured to generate an operation signal and deliver the operation signal via the connecting mechanism to the sewing machine body, the operation signal being according to operation of each operating member; and a position adjusting mechanism that is configured to change a position of at least one of the operating members mounted on the base, the position adjusting mechanism including a distance adjusting mechanism that is configured to adjust a distance between the at least two detectors in an increasing or decreasing direction.

5. The sewing machine according to claim 4, wherein the distance adjusting mechanism includes:

a support mechanism that is configured to support one of the two detectors so that the one detector is slidable in a distance increasing or decreasing direction;

a plurality of engagement recesses which is arranged in a direction of the sliding movement;

an engagement claw which is provided at one detector side to selectively engage with one of the engagement recesses thereby to fix the one detector;

a biasing member that is configured to bias the engagement claw in a direction of engagement with one of the engagement recesses; and a manually operated portion that is configured to disengage the engagement claw from the one of the engagement recesses against a biasing force of the biasing member thereby to allow the engagement claw to move.

6. The sewing machine according to claim 4, further comprising a support pedestal that is configured to support one of the at least two detectors, wherein the distance adjusting mechanism includes an elongate screw insertion hole which is formed in either the base or the support pedestal so as to extend in a direction of increasing or decreasing the distance and a screw member that is configured to fix the support pedestal at an arbitrary position in the elongate screw insertion hole relative to the base so that the support pedestal is displaceable.

* * * * *